United States Patent [19]

Bany et al.

[11] Patent Number: 4,516,004

[45] Date of Patent: May 7, 1985

[54] VACUUM SWITCHING TUBE WITH A HELICAL CURRENT PATH

[75] Inventors: Peter-Michael Bany; Wolfgang Berger; Hans Bettge; Gunter Bialkowski; Rafl Rozek; Norbert Steinemer; Claus-Jurgen Volkmann, all of Berlin, Fed. Rep. of Germany

[73] Assignee: Siemens Aktiengesellschaft, Munich, Fed. Rep. of Germany

[21] Appl. No.: 524,198

[22] Filed: Aug. 18, 1983

[30] Foreign Application Priority Data

Aug. 31, 1982 [DE] Fed. Rep. of Germany ..... 3232708

[51] Int. Cl.[3] ..... H01H 33/66

[52] U.S. Cl. ..... 200/144 B; 200/147 R; 200/147 A

[58] Field of Search ..... 200/144 B, 147 A, 147 R

[56] References Cited

U.S. PATENT DOCUMENTS

| | | | |
|---|---|---|---|
| 3,158,722 | 11/1964 | Porter | 200/147 |
| 3,263,050 | 7/1966 | Pflanz et al. | 200/144 B |
| 3,711,665 | 1/1973 | Dethlefsen | 200/144 B |
| 4,151,391 | 4/1979 | Rolff et al. | 200/147 R |
| 4,459,446 | 7/1984 | Wolf | 200/147 A |

FOREIGN PATENT DOCUMENTS

| | | | |
|---|---|---|---|
| 3033632 | 4/1982 | Fed. Rep. of Germany . | |
| 1266130 | 5/1961 | France | 200/144 B |
| 43-3242 | 2/1968 | Japan | 200/144 B |
| 46-16851 | 5/1971 | Japan | 200/144 B |

*Primary Examiner*—Robert S. Macon
*Attorney, Agent, or Firm*—Kenyon & Kenyon

[57] ABSTRACT

A vacuum switching tube having an evacuated housing in which contacts are disposed movable relative to each other and an improved current lead for such a vacuum tube are disclosed. The current lead comprises a core and a jacket surrounding the core. The core is made of a material with low electric conductivity compared to the jacket and has a helical outer contour. The core can be made by twisting a rod of polygonal or star-shaped cross section. A jacket of a material with relatively high electrical conductivity and with a smooth cylindrical outer contour is applied to the core. The jacket is joined to the core firmly without space between them or is made in one piece with the core.

18 Claims, 6 Drawing Figures

FIG 2
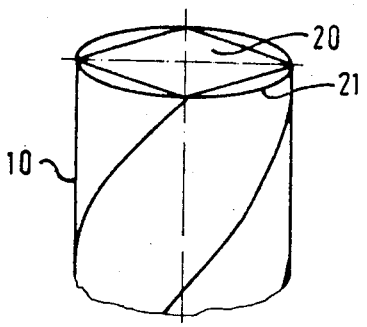
FIG 3
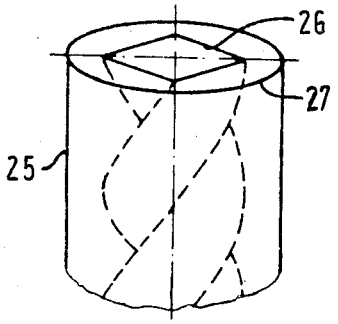
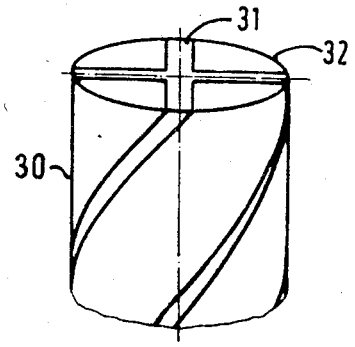
FIG 4
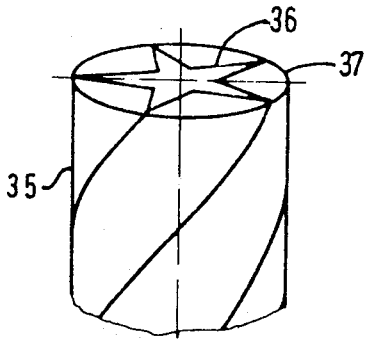
FIG 5
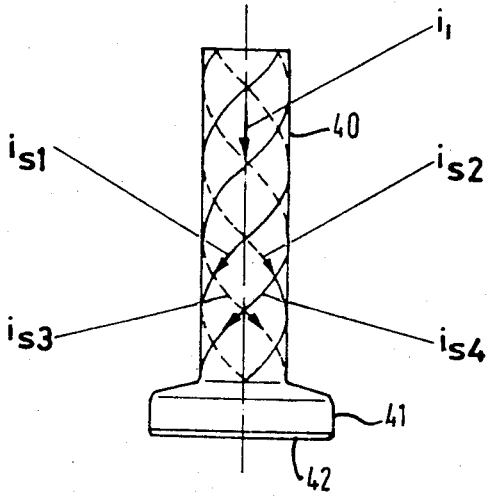
FIG 6

VACUUM SWITCHING TUBE WITH A HELICAL CURRENT PATH

BACKGROUND OF THE INVENTION

The present invention relates to a vacuum switching tube having contacts which are arranged movably relative to each other within an evacuated housing, and to a current lead for at least one of the contacts having a core and a conductor surrounding the core to provide a helical current path.

A vacuum switching tube having contacts relatively movably arranged in an evacuated housing is disclosed in DE-OS No. 3 033 632. A helical current path is provided by a current lead to one of the contacts having a core and a conductor surrounding the core. The helical current path produces a current-dependent magnetic field which is effective during switching between the separated contacts and has an advantageous effect on switching capacity. The advantageous properties produced by a helical current path, especially those produced by axially-directed magnetic fields in vacuum switching tubes, are counterbalanced by the difficulty in realizing the helical current path in a technically effective and economically advantageous manner. For example, fastening a helical conductor and mutually bracing its turns presents difficulties because connecting means and supports available for this purpose are subjected to considerable thermal and mechanical stresses. In particular, thermal expansions and corresponding mechanical stresses occur during operation, in addition to which are mechanical shock forces and additional electrodynamic forces occurring during switching.

It is known to realize a helical current path along a current lead of a vacuum switching tube by cuts made at the circumference of the current lead which are offset relative to each other (U.S. Pat. No. 3,158,722). The effectiveness of this arrangement, however, is limited by the fact that the cuts cannot be made to any desired depth in view of the required mechanical strength of the current lead. Additionally, associated with making the cuts, even if they are straight and extend perpendicularly to the longitudinal axis of the current lead, is a rather elaborate chip-removing machining operation. Cleaning and degassing the machined parts present additional problems.

OBJECTS AND SUMMARY OF THE INVENTION

It is an object of the present invention to provide a current lead which is suitable for generating a magnetic field and which is mechanically extremely strong while highly effective, and can be manufactured economically.

It is another object of the present invention to provide such a current lead having a helical current path.

It is another object of the present invention to provide such a current lead which generates an axially-directed magnetic field.

According to the invention, the above and other objects are achieved by a current lead which comprises a core having a helical outer contour and a conductor surrounding the core, the electrical conductivity of the core being less than that of the conductor. Preferably, the electrical conductivity of the core is relatively low while that of the conductor is relatively high. The conductor is formed by a jacket of made either in one piece with the core or firmly connected to the core without any space between the core and the jacket. The jacket has a smooth cylindrical outer contour.

In the current lead according to the invention, the conductor is not formed by a separately produced coil. The conductor is rather produced by complementing a helically-contoured core with conductor material to form a cylindrical body. The invention provides an approach to chipless fabrication of an integral current lead member having the electrical properties of a coil and the mechanical properties of a solid conductor.

The magnetic effect desired to be caused by the current lead can be achieved in principle equally well with electrically conducting or non-conducting cores. In general, however, cores of metallic material the conductivity of which is less than the conductivity of the conductor are preferred. For example, resistive materials having a conductivity several times less than that of copper, which can be used for the conductor, and to which the conductor can be joined well can be used. It may further be advantageous to make the core of a ferromagnetic material. Ferromagnetic materials likewise have a sufficiently low electrical conductivity as compared to customary conductor materials and at the same time focus the magnetic field and thereby increase the magnetic induction available in the space between the contacts.

The helical outer contour of the core can be realized in different ways. According to one aspect of the invention a rod of angular cross section is twisted about its longitudinal axis, whereby a current path having a fraction of a turn up to several turns per unit length can be produced depending on the rod cross section selected and how many parallel helical paths are formed. Accordingly, rods with polygonal or star-shaped cross sections are suitable.

A number of known methods are suitable for producing a current lead having a core and a jacket. For example, casting processes can be used advantageously if the melting point of the core material is sufficiently higher than the melting point of the jacket material. The highly electrically conductive material can then be cast around the less conductive core in a cylindrical mold to form the jacket.

The jacket material can be applied to the core also by extrusion molding. This method is less dependent on the melting points of the materials.

A current lead can also be produced by powder-metallurgy methods in which the highly conductive material is applied to the core by powder-metallurgy techniques to form the jacket. The jacket material is a metal powder which is applied to the core by, for example, a pressing operation in a die. The jacket layer formed thereby is subsequently sintered by heating to form a solid body.

In the description of the above-described methods formation of the current lead contact was not described. In accordance with an aspect of the invention, respective contacts can simultaneously be formed with the current leads using the above-described methods. This can be accomplished by shaping the casting or pressing molds correspondingly to accomodate a contact which has the advantage that separate manufacturing operations for the contact and joining thereof to the current lead are eliminated. Mechanical strength of the current lead/contact and current transfer are both improved.

The above and other objects, features, aspects and advantages of the present invention will be more readily perceived from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like numerals indicate similar parts and in which:

FIG. 2 is a perspective view of part of a current lead according to the invention of the vacuum switching tube of FIG. 1;

FIG. 3 is a perspective view of part of a current lead according to another embodiment of the invention;

FIG. 4 is a perspective view of part of a current lead according to another embodiment of the invention;

FIG. 5 is a perspective view of part of a current lead according to another embodiment of the invention; and FIG. 6 is a side schematic view of a current lead having a formed-on contact in accordance with the invention showing current flows in the current lead which are designated by arrows.

DESCRIPTION OF THE PREFERRED EMBODIMENTS

Figure 1:
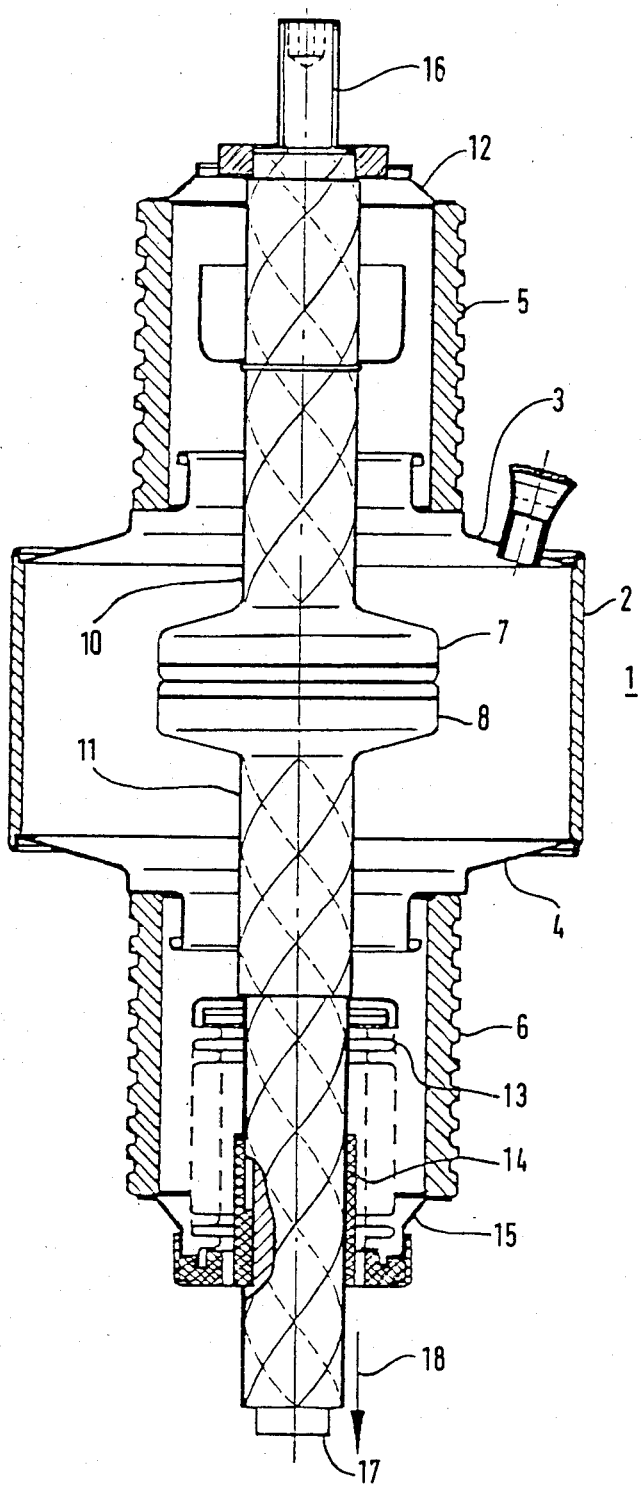
FIG. 1 is an axial cross-section view of a vacuum switching tube having a current lead according to the invention.

A vacuum switching tube 1 is depicted in FIG. 1 which includes current leads according to the invention. The vacuum switching tube 1 is conventional except for the current leads, contacts and their connection together.

The housing of the vacuum switching tube 1 is formed by a central metal cylinder 2 and ceramic insulating bodies 5 and 6 mounted on both sides of the metal cylinder. Conical transition pieces 3 and 4 are disposed between the metal cylinder 2 and the insulating bodies. The metal cylinder 2 surrounds the cooperating switching contacts 7 and 8 to which rod-shaped current lead members 10 and 11 are connected. Contact 7 with its current lead member 10 is fixed and is connected vacuum-tight to an end cap 12 of the insulating body 5. Contact 8 with its current lead member 11 on the other hand is guided axially movably, vacuum-tightly in another end cap 15 of the insulating body 6 by means of spring bellows 13 and a bearing sleeve 14. The vacuum switching tube 1 is provided with a fixed upper connecting stud 16 and an axially movable lower contact stud 17 for installing the tube in switching equipment.

The current lead members 10 and 11 have a core and a surrounding jacket shaped such that a current flowing through them generates an axially-directed magnetic field. When the contacts 7 and 8 are separated after movement of the contact stud 17 in the direction of arrow 18, the magnetic field permeates the space between the contacts and influences the arc burning therein. The direction of the magnetic field in the arcing space depends on the winding direction of helical conductor paths in the current lead members. If the winding direction is the same in both current lead members, the resulting magnetic field extends along the axis of the contact arrangement. If, on the other hand, the winding direction is opposite in both current lead members, a radially-directed magnetic field is obtained in the space between the contacts 7 and 8. Depending on the shape of the current lead members and the contacts as well as on the materials used, the direction of the magnetic field in the space between the contacts can be a combination of both fields described above and may differ locally as to magnitude and direction.

The current lead member 10 shown partially in FIG. 2 a core 20 of a material having relatively low conductivity, for example, an iron, e.g. ferromagnetic, containing material. The core is surrounded by a jacket 21, the outside diameter of which corresponds to a diagonal dimension of the core 20. The jacket 21 comprises a material of relatively high electrical conductivity, for example, copper, and may be applied to the core 20 by one of the methods described above. The core 20 in the embodiment of FIG. 2 is a rod of square cross section which is twisted about its longitudinal axis, as shown in FIG. 2. Thereby, four helical current paths are provided in the jacket 21 which are connected electrically in parallel.

In FIG. 3, a current lead member 25 is shown having the same outside diameter as the current lead member 10 in FIG. 2 but utilizing a twisted core 26 with a smaller diagonal dimension. The jacket 27 is thereby not subdivided into four separate, parallel helical current paths as in the embodiment of FIG. 2. Current entering the current lead member 25 is nevertheless made to flow around the core 26 in helix fashion because such a path corresponds to the path of least resistance. A longitudinal current is superimposed on the helical current and depends on the difference between the outside diameter of the jacket 27 and the diagonal dimension of the core 26, as well as on the electronic conductivity of the materials of the core and the jacket.

In the current lead member 30 depicted in FIG. 4, the core 31 is in the shape of a star, i.e. a cross-shaped star, as opposed to the regular polygonal sectioned cores of FIGS. 2 and 3. The long dimension of the cross members corresponds to the outside diameter of the jacket 32. The cross-shaped core 31 is twisted, and similar to the embodiment of FIG. 2, four electrically parallel-connected helically wound regions of the jacket 32 are formed. Due to the cross shape of the core, the relatively highly conductive jacket material forms a larger part of the current lead member as compared to the current lead member of FIG. 2. If the same electric conductivities are assumed for the jacket and the core in the current lead members of FIGS. 2 and 4, the purely longitudinal current relative to the helical current is reduced in the embodiment of FIG. 4.

The current lead member 35 in FIG. 5 includes a twisted core 36 which is star-shaped with the tips or the points of the star lying on a circle having a diameter equal to that of jacket 37. The jacket 37 is subdivided into five helical regions, corresponding to the number of the points of the star.

Relative portions of the total cross section formed by the core and the jacket depend on the cross section of the core. In general, the portion of the total cross section formed by the core cross section in the embodiment of FIG. 3 will be less than in the embodiment of FIG. 2, but larger than in the embodiment of FIG. 4.

As mentioned, different methods may be used for producing the current lead members. If a casting method is used, it is not necessary in the embodiments according to FIGS. 2, 4 and 5 to center the cores 20, 31 and 36 in the respective molds because centering is accomplished by the edges of the cores. In the embodiment according to FIG. 3, it is necessary to center the core 26 in the mold by suitable means which are known in the foundary art. The same applies also to extrusion molding and a sintering process.

In FIG. 6, a current lead member 40 is shown which is made together with contact 41 in one piece. As opposed to contacts 7 and 8 in FIG. 1, contact 41 is an unslotted-plane contact. After current lead number 40 is formed with contact 41, a contact facing 42 of an arc-resistant material which also has the property of low break-off current is applied. In FIG. 6, the pure longitudinal current flowing through the current lead member 40 is designated $i_1$ which is composed, as mentioned, of two components depending on the shape of the core and the jacket. One component is the current flowing through the core while the other component is the purely longitudinal current flowing through the jacket. Four helical currents $i_{s1}$, $i_{s2}$, $i_{s3}$ and $i_{s4}$ are shown in FIG. 6 which may correspond to the helical currents occurring in the current lead members of FIGS. 2, 3 and 4. To show the current distribution for FIG. 5, a fifth helical current would be added to the diagram of FIG. 6. However, the number of turns by which the current circumvents the core may differ depending on how much the core is twisted for a given length. The number of turns that the core is twisted also has a direct influence on the magnitude of the axial magnetic field produced.

Certain changes and modifications of the embodiments of the invention disclosed herein will be readily apparent to those skilled in the art. It is the applicants' intention to cover by their claims all those changes and modifications which could be made to the embodiments of the invention herein chosen for the purpose of disclosure without departing from the spirit and scope of the invention.

What is claimed is:

1. In a vacuum switching tube including an evacuated housing, contacts movable relative to each other disposed within the housing and a current lead connected to at least one of the contacts, the improvement comprising the current lead comprising a core having a helical outer contour and a conductor surrounding the core, the core having a conductivity which is less than that of the conductor.

2. The improvement according to claim 1 wherein the core and conductor are of one piece construction.

3. The improvement according to claim 1 wherein the core and conductor are separate pieces firmly connected together without any space between them.

4. The improvement according to claim 1 wherein the conductor has a smooth cylindrical outer contour.

5. The improvement according to claim 1 wherein the core comprises resistance material.

6. The improvement according to claim 1 wherein the core comprises ferromagnetic material.

7. The improvement according to claim 1 wherein the core is a twisted rod of polygonal cross-section.

8. The improvement according to claim 1 wherein the core is a twisted rod of star-shaped cross section.

9. A current lead to a contact in a vacuum switching tube comprising a core having a helical outer contour and a conductor surrounding the core, the core having a conductivity which is less than that of the conductor.

10. The current lead according to claim 9 wherein the conductor has a smooth cylindrical outer contour.

11. The current lead according to claim 9 wherein the core comprises resistance material.

12. The current lead according to claim 9 wherein the core is a twisted rod of polygonal shapel.

13. The current lead, according to claim 9 wherein the core is a twisted rod of star-shaped cross section.

14. A method for manufacturing a current lead for a vacuum switching tube comprising providing a core having a helical outer contour and applying an electrical conductor around the core as an outer conductor, the conductivity of the core being less than that of the conductor.

15. The method according to claim 14 wherein the conductor is cast about the core in a cylindrical mold.

16. The method according to claim 14 wherein the conductor is applied to the core by extrusion molding.

17. The method according to claim 14 wherein the conductor is applied to the core by powder-metallurgy techniques.

18. The method according to claim 14 wherein a contact is formed simultaneously with the application of the conductor to the core so that the conductor and contact are formed as one piece.

* * * * *